US005996957A

United States Patent [19]

Kurtz

[11] Patent Number: 5,996,957

[45] Date of Patent: Dec. 7, 1999

[54] ROTATIONAL BEVERAGE HOLDER

[76] Inventor: Thomas M. Kurtz, 98 Willowtree La., Newark, Del. 19702

[21] Appl. No.: 09/053,827

[22] Filed: Apr. 2, 1998

[51] Int. Cl.[6] ..... A47K 1/08

[52] U.S. Cl. ..... 248/311.2; 248/231.21; 248/309.1; 248/292.13

[58] Field of Search ..... 248/311.2, 227.2, 248/231.21, 231.41, 231.61, 292.12, 314, 315, 309.1, 214, 291.1, 102–104, 510, 231.85, 292.13

[56] References Cited

U.S. PATENT DOCUMENTS

| | | | |
|---|---|---|---|
| 802,705 | 10/1905 | Parker | 248/292.13 |
| 931,437 | 8/1909 | Larson | 248/314 |
| 1,349,225 | 8/1920 | Rosenblum | 24/527 |
| 1,760,346 | 5/1930 | Correa | 24/7.5 |
| 2,716,531 | 8/1955 | Johnson | 248/292.13 X |
| 4,887,784 | 12/1989 | Kayali | 248/311.2 |
| 5,517,732 | 5/1996 | Crear | 248/231.41 X |
| 5,738,322 | 4/1998 | Huang | 248/311.2 X |
| 5,842,671 | 12/1998 | Gibbs | 248/231.41 |

*Primary Examiner*—Leslie A. Braun
*Assistant Examiner*—Gwendolyn Baxter

[57] ABSTRACT

A rotational beverage holder including a support member that has a back plate with a ring and a bottom portion with a base member projecting therefrom. Included is a rotatable locking mechanism. The locking meachnism has a first member and a second member. The first member is mounted to a rear face of the back plate. The second member has a generally rectangular projection with a receiving hole extending therefrom. The first member and the second member are resiliently coupled by a spring. A clamping mechanism with an adjustable member and a stationary member, is provided. The adjustable member has a self locking rachet release. The stationary member has a vertical projection extending therefrom positioned through the receiving opening and the adjustable member. The adjustable member is movable up and down the vertical projection.

6 Claims, 2 Drawing Sheets

ROTATIONAL BEVERAGE HOLDER

BACKGROUND OF THE INVENTION

1. Field of the Invention

The present invention relates to a rotational beverage holder and more particularly pertains to providing an apparatus that can be releasably mounted to various objects for holding a beverage container in a upright orientation.

2. Description of the Prior Art

The use of a beverage holder is known in the prior art. More specifically, beverage holders heretofore devised and utilized for the purpose of supporting a beverage container are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,007,612 to Manfre discloses a rail mate. U.S. Pat. No. 4,887,784 to Kayali discloses an adjustable drink holder. U.S. Pat. No. Des. 350,456 to Linder discloses a cup holder. U.S. Pat. No. 4,997,156 to Allen discloses a holder for a beverage container. U.S. Pat. No. 4,993,611 to Longo discloses a beverage container support. Lastly, U.S. Pat. No. 4,878,642 to Kirby discloses an object support for attachment to a cylindrically shaped support member.

In this respect, the rotational beverage holder according to the present invention substantially departs from the conventional concepts and designs of the prior art, and in so doing provides an apparatus primarily developed for the purpose of providing an apparatus that can be releasably mounted to various objects for holding a beverage container in a upright orientation.

Therefore, it can be appreciated that there exists a continuing need for a new and improved Rotational beverage holder which can be used for providing an apparatus that can be releasably mounted to various objects for holding a beverage container in a upright orientation. In this regard, the present invention substantially fulfills this need.

SUMMARY OF THE INVENTION

In view of the foregoing disadvantages inherent in the known types of beverage holders now present in the prior art, the present invention provides an improved rotational beverage holder. As such, the general purpose of the present invention, which will be described subsequently in greater detail, is to provide a new and improved rotational beverage holder which has all the advantages of the prior art and none of the disadvantages.

To attain this, the present invention essentially comprises a support member that has a back plate. The back plate has a top edge and a bottom portion with a base member projecting therefrom. The back plate has a front face with a ring member extending therefrom. The support member is sized and shaped for receiving a container through the ring member for allowing the ring member and base member to retain the container.

Included is a rotatable locking mechanism. The rotatable locking mechanism has a first member and a second member. The first member is mounted to a rear face of the back plate of the support member. The first member has a first serrated side. The second member has a generally rectangular projection extending therefrom and a second serrated side. The rectangular projection has a receiving hole. The first member and the second member are resiliently coupled by a spring. The spring has one end that is mounted within the first member and another end that is mounted within the projection of the second member. The spring exerts a tension for allowing the first serrated side of the first member to be held in an interlocking orientation with the second serrated side of the second member.

Lastly, a clamping mechanism is provided. The clamping member has an adjustable member and a stationary member. The adjustable member has a first under side, a first upper side and a first opening passing therethrough. The adjustable member has a self locking rachet release. The stationary member has a second upper side, a second under side and a vertical projection extending from the second under side. The vertical projection is positioned through the receiving opening and the first opening of the adjustable member. The adjustable member is movable up and down about the first opening by the pressing the self locking rachet release.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rotational beverage holder which has all the advantages of the prior art beverage holders and none of the disadvantages.

It is another object of the present invention to provide a new and improved rotational beverage holder which may be easily and efficiently manufactured and marketed.

It is a further object of the present invention to provide a new and improved rotational beverage holder which is of a durable and reliable construction.

An even further object of the present invention is to provide a new and improved rotational beverage holder which is susceptible of a low cost of manufacture with regard to both materials and labor, and which accordingly is then susceptible of low prices of sale to the consuming public, thereby making such Rotational beverage holder economically available to the buying public.

Still yet another object of the present invention is to provide a new and improved rotational beverage holder which provides in the apparatuses and methods of the prior art some of the advantages thereof, while simultaneously overcoming some of the disadvantages normally associated therewith.

Still another object of the present invention is to providing an apparatus that can be releasably mounted to various objects for holding a beverage container in a upright orientation.

Lastly, it is an object of the present invention to provide a new and improved a support member that has a back plate with a ring and a bottom portion with a base member projecting therefrom. Included is a rotatable locking mechanism. The locking mechanism has a first member and a second member. The first member is mounted to a rear face of the back plate. The second member has a generally rectangular projection with a receiving hole extending therefrom. The first member and the second member are resiliently coupled by a spring. A clamping mechanism with an adjustable member and a stationary member, is provided. The adjustable member has a self locking rachet release. The stationary member has a vertical projection extending therefrom positioned through the receiving opening and the adjustable member. The adjustable member is movable up and down about the vertical projection by pressing the self locking rachet release.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
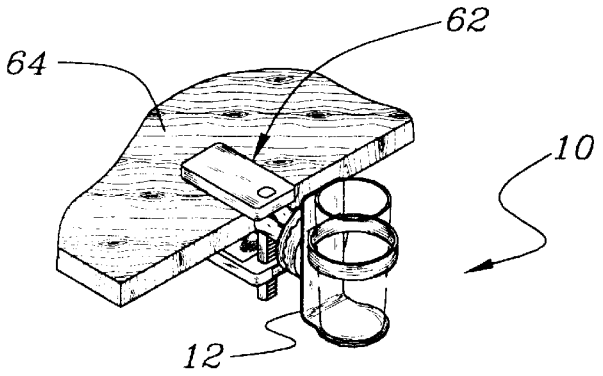
FIG. 1 is a perspective illustration of the preferred embodiment of the rotational beverage holder constructed in accordance with the principles of the present invention.
Figure 2:
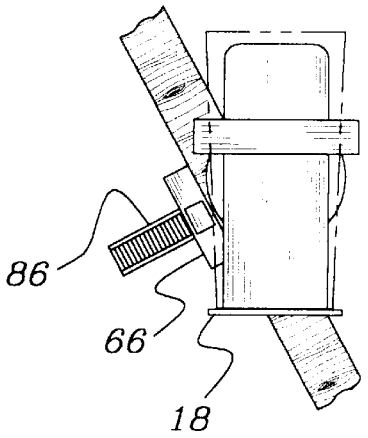
FIG. 2 is an isometric view of the present invention in an operable orientation.

With reference now to the drawings, and in particular to FIG. 1 thereof, a new and improved rotational beverage holder embodying the principles and concepts of the present invention and generally designated by the reference numeral 10 will be described.

The present invention, the new and improved rotational beverage holder, is comprised of a plurality of components. Such components in their broadest context include a support member, a locking mechanism and a clamping member. Such components are individually configured and correlated with respect to each other so as to attain the desired objective.

Figure 3:
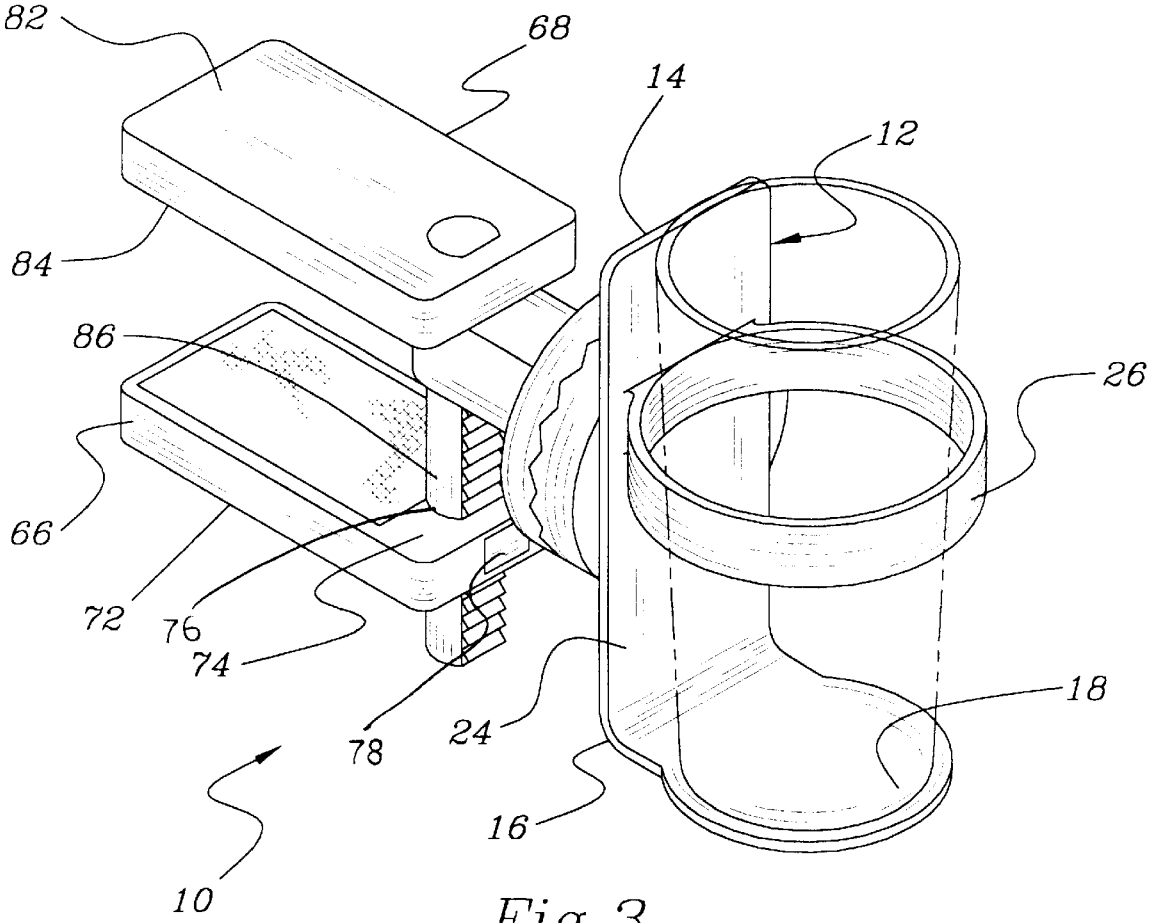
FIG. 3 is an enlarged isometric view of the present invention.

More specifically, the present invention includes a support member that has a back plate 12 that is formed of a rigid plastic. The back plate has a top edge 14 and a bottom portion 16 with a base member 18. The base member projects outwardly from the bottom portion and has a circular shape. The back plate has a front face 24 with a ring member 26. The ring member extends from the front face and is spaced from the top edge. The support member is sized and shaped for receiving a container through the ring member for allowing the ring member and base member to retain the container, as shown in FIG. 3.

Figure 4:
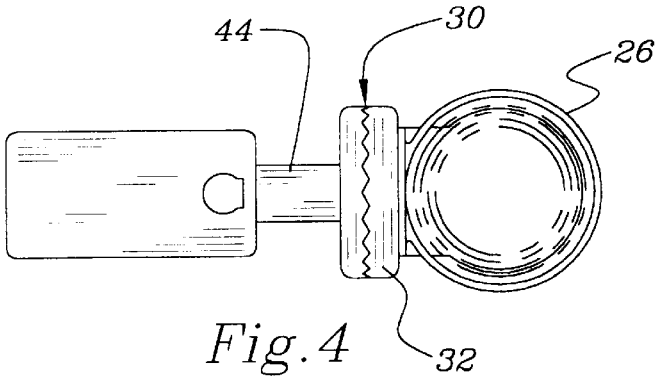
FIG. 4 is a top plan view of the present invention.
Figure 5:
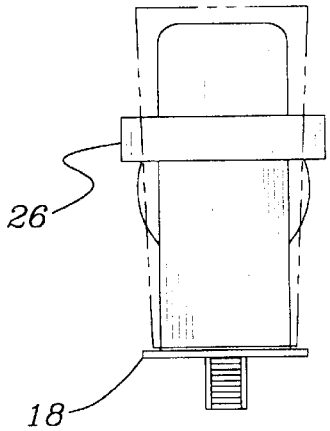
FIG. 5 is frontal view of the present invention.
Figure 6:
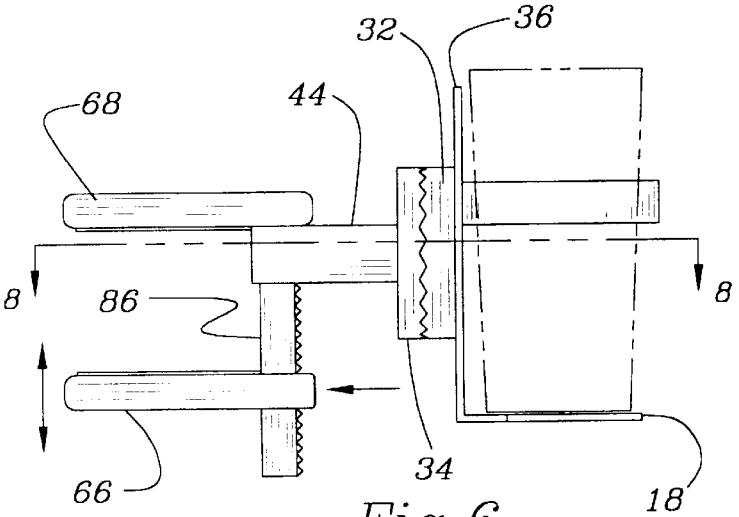
FIG. 6 is side view of the present invention.

Included is a rotatable locking mechanism 30. The rotatable locking mechanism has a first member 32 and a second member 34, as depicted in FIG. 4. The first member is mounted to a rear face 36 of the back plate 12 of the support member. The first member has a first serrated side 42. The second member has a generally rectangular projection 44 that extend outward therefrom.

Figure 7:
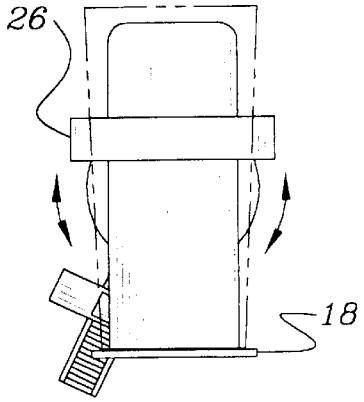
FIG. 7 is an operable view of the presentation showing the rotation of the support member.
Figure 8:
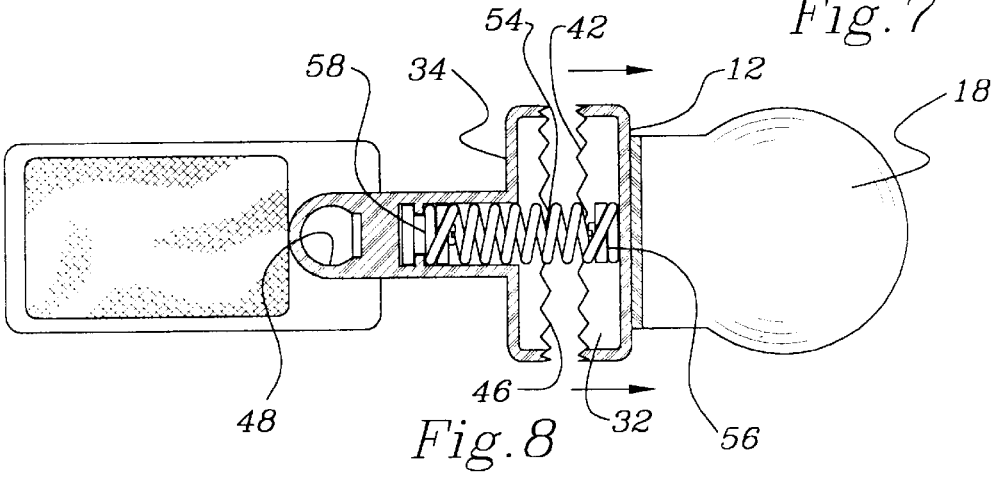
FIG. 8 is a cross-sectional view of the locking mechanism of the present invention taken along line 8—8 of FIG. 6.

Also, the second member has a second serrated side 46. The rectangular projection has a receiving hole 48. The first member and the second member are resiliently coupled by a spring 54, as shown in FIG. 8. The spring has one end 56 that is mounted within the first member and another end 58 that is mounted within the projection of the second member. The spring exerts a tension that allows the first serrated side of the first member to be held in an interlocking orientation with the second serrated side of the second member. The spring allows the first member and the second member to be pulled apart for the rotation of the support member as shown in FIG. 7.

Additionally, a clamping mechanism 62 is provided and is shown in FIG. 1 mounted to a table 64. The clamping member has an adjustable member 66 and a stationary member 68. As illustrated in FIG. 3, the adjustable member has a first under side 72, a first upper side 74 and a first opening 76 passing therethrough. The adjustable member has a self locking rachet release 78.

Lastly, the stationary member has a second upper side 82, a second under side 84 and a vertical projection 86. The vertical projection has a serrated side and extends from the second under side. The vertical projection is positioned through the receiving opening 48 and the first opening of the adjustable member. The serrated side of the vertical projection is engaged by the self locking rachet release of the adjustable member. The adjustable member moves up and down about the vertical projection when the self locking rachet release is pressed. The movement of the adjustable member about the vertical projection cause the clamping member to be securely clamped onto a variety of objects.

The present invention rotational beverage holder will clamp onto objects for securing a beverage in an upright orientation. The clamping member is clamped onto the object by tightening the adjustable member. The support member is adjusted at the locking mechanism to endure that the beverage is held in the upright position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved rotational beverage holder for supporting a container comprising, in combination:

a support member having a back plate with a top edge and a bottom portion with a base member projecting therefrom, the back plate having a front face with a ring member extending therefrom, the support member being sized and shaped for receiving a container through the ring member and allowing the ring member and base member to retain the container;

a rotatable locking mechanism having a first member and a second member, the first member being mounted to a rear face of the back plate of the support member, the first member having a first serrated side, the second member having a generally rectangular projection extending therefrom and a second serrated side, the rectangular projection having a receiving hole therein, the first member and the second member being resiliently coupled by a spring, the spring having one end being mounted within the first member and another end being mounted within the projection of the second member, the spring exerting a tension for allowing the first serrated side of the first member to be held in an interlocking orientation with the second serrated side of the second member; and a clamping mechanism having an adjustable member and a stationary member, the adjustable member having a first under side, a first upper side and a first opening passing there through, the adjustable member having a self locking rachet release, the stationary member having a second upper side, a second under side and a vertical projection extending from the second under side, the vertical projection being positionable through the receiving opening and the first opening of the adjustable member, the adjustable member being movable up and down about the vertical projection within the first opening by pressing the self locking rachet release.

2. A rotational beverage holder comprising:

a support member having a back plate with a ring and a bottom portion with a base member projecting therefrom,;

a rotatable locking mechanism having a first member and a second member, the first member being mounted to a rear face of the back plate, the second member having a generally rectangular projection with a receiving hole extending therefrom, the first member and the second member being resiliently coupled by a spring; and a clamping mechanism having an adjustable member and a stationary member, the adjustable member having a self locking rachet release, the stationary member having a vertical projection extending therefrom positioned through the receiving opening and the adjustable member, the adjustable member being movable up and down about the vertical projection by pressing the self locking rachet release.

3. The rotational beverage holder as set forth in claim 2, wherein back plate of the support member having a top edge and a front face, the support member being sized and shaped for receiving a container through the ring member and allowing the ring member and base member to retain the container.

4. The rotational beverage holder as set forth in claim 2, wherein the first member having a first serrated side, and the second member having a second serrated side.

5. The rotational beverage holder as set forth in claim 4, wherein the spring having one end being mounted within the first member and another end being mounted within the projection of the second member, the spring exerting a tension for allowing the first serrated side of the first member to be held in an interlocking orientation with the second serrated side of the second member.

6. The rotational beverage holder as set forth in claim 2, wherein the adjustable member having a first under side, a first upper side and a first opening passing therethrough, the stationary member having a second upper side and a second under side.

* * * * *